US007461712B2

(12) United States Patent
Law et al.

(10) Patent No.: US 7,461,712 B2
(45) Date of Patent: Dec. 9, 2008

(54) TRACK-MOUNTED DRILLING MACHINE WITH ACTIVE SUSPENSION SYSTEM

(75) Inventors: Arnold R. Law, Garland, TX (US); Ajay Kumar, Garland, TX (US)

(73) Assignee: Atlas Copco Drilling Solutions, Garland, TX (US)

( * ) Notice: Subject to any disclaimer, the term of this patent is extended or adjusted under 35 U.S.C. 154(b) by 0 days.

(21) Appl. No.: 11/953,434

(22) Filed: Dec. 10, 2007

(65) Prior Publication Data

US 2008/0087468 A1 Apr. 17, 2008

Related U.S. Application Data

(62) Division of application No. 11/165,145, filed on Jun. 23, 2005, now Pat. No. 7,325,634.

(51) Int. Cl.
*B62D 55/084* (2006.01)

(52) U.S. Cl. ..... 180/41; 180/9.5

(58) Field of Classification Search ..... 180/41, 180/9.1, 9.5

See application file for complete search history.

(56) References Cited

U.S. PATENT DOCUMENTS

| | | | | |
|---|---|---|---|---|
| 2,694,581 | A | 11/1954 | Helmle | |
| 2,845,251 | A | 7/1958 | Barton | |
| 2,851,116 | A | 9/1958 | Collins | |
| 2,953,393 | A | 9/1960 | Lucien | |
| 3,417,832 | A | 12/1968 | Ziccardi | |
| 3,430,790 | A | 3/1969 | Beltrami | |
| 3,899,037 | A * | 8/1975 | Yuker | 180/6.48 |
| 4,703,811 | A | 11/1987 | Lam | |
| 4,881,609 | A | 11/1989 | Purcell et al. | |
| 5,097,916 | A | 3/1992 | Brandstadter | |
| 5,143,386 | A | 9/1992 | Uriarte | |
| 5,755,382 | A | 5/1998 | Skotinkov | |
| 5,806,616 | A | 9/1998 | Enlund et al. | |
| 6,012,724 | A | 1/2000 | Pitkanen | |
| 6,056,304 | A | 5/2000 | Brambilla | |
| 6,082,927 | A | 7/2000 | Dahlinger et al. | |
| 6,173,973 | B1 | 1/2001 | Robinson | |
| 6,209,669 | B1 | 4/2001 | Young | |
| 6,805,362 | B1 | 10/2004 | Melcher | |
| 2003/0060923 | A1 | 3/2003 | Scotese | |

* cited by examiner

*Primary Examiner*—Kevin Hurley
(74) *Attorney, Agent, or Firm*—Michael Best & Friedrich

(57) ABSTRACT

A drilling machine includes a frame, a tower that is supported by the frame, two tracks for movement over the ground, at least three yokes that interconnect the frame and the two tracks, at least three hydraulic cylinders, an inclinometer that senses the inclination of the frame and produces an output signal that is indicative of the inclination of the frame, and a controller that receives the output signal from the inclinometer. The tower includes a drill string. Each yoke is connected to the frame and one of the tracks. Each hydraulic cylinder is extendible and retractable in response to an associated control signal and connected to the frame and an associated yoke. The controller generates control signals for the hydraulic cylinders such that the hydraulic cylinders are controlled to extend or retract to maintain the frame in a level position.

3 Claims, 4 Drawing Sheets

TRACK-MOUNTED DRILLING MACHINE WITH ACTIVE SUSPENSION SYSTEM

RELATED APPLICATIONS

This patent application is a divisional of U.S. patent application Ser. No. 11/165,145, filed Jun. 23, 2005 the entire contents of which are hereby incorporated by reference.

FIELD OF THE INVENTION

The invention relates to a track-mounted drilling machine and in particular to a track-mounted drilling machine including an active suspension system.

BACKGROUND OF THE INVENTION

Track-mounted drilling machines include a frame supported by two tracks (also known as crawlers) for movement over the ground (also known as tramming). Typical drilling machines include an operator cab, a tower, a rotary head and a drill string. The operator cab and tower are mounted on the frame, with the tower pivotable with respect to the frame such that the tower can be lowered into a horizontal position for transport and raised to a generally vertical position for drilling. The rotary head is mounted to the tower, is connected to the drill string, and is operable to rotate the drill string and force the drill string downward to penetrate the ground at a desired angle and create a drilled hole.

With prior art drilling machines, prior to drilling a hole, it is necessary to level the frame and then pivot the tower to a desired vertical position with respect to the frame in order to ensure that the drill string penetrates the ground at a desired orientation with respect to gravity. Typically the leveling is accomplished using jacks once the drilling machine has been moved to its desired drilling position.

Additionally, most prior art drilling machines include at best passive, non-independent suspension systems that only partially absorb ground forces resulting from movement over uneven surface terrain, often resulting in a bumpy ride for the operator. For example, some prior art machines include a rigid connection between the tracks and the frame only allowing a rotation motion of the tracks with respect to the frame. Such a rigid connection significantly limits the maximum tramming speed of the drilling machine.

SUMMARY OF THE INVENTION

In one construction the invention provides a drilling machine that includes a frame, a tower that is supported by the frame, two tracks for movement over the ground, at least three yokes that interconnect the frame and the two tracks, at least three hydraulic cylinders, an inclinometer that senses the inclination of the frame and produces an output signal that is indicative of the inclination of the frame, and a controller that receives the output signal from the inclinometer. The tower includes a drill string. Each yoke is pivotably connected to the frame and connects to one of the tracks. Each hydraulic cylinder is extendible and retractable in response to an associated control signal and connected to the frame and an associated yoke. The controller generates control signals for the hydraulic cylinders such that the hydraulic cylinders are controlled to extend or retract to maintain the frame in a level position, even when the tracks are not parallel to each other.

Other features and advantages of the invention will become apparent to those skilled in the art upon review of the following detailed description, claims, and drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
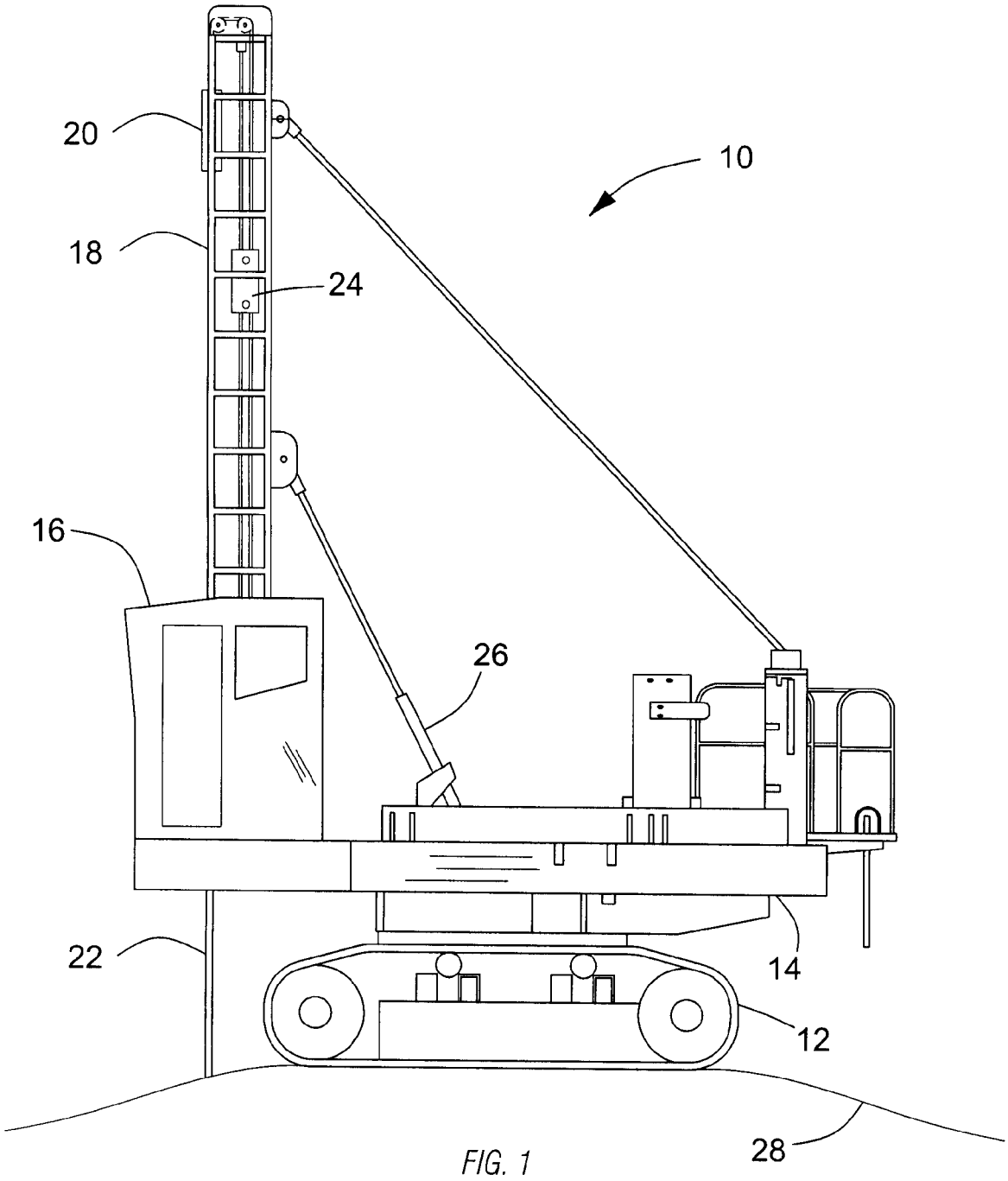
FIG. 1 is a simplified side view of one embodiment of a drilling machine showing the tower in a vertical position.
Figure 2:
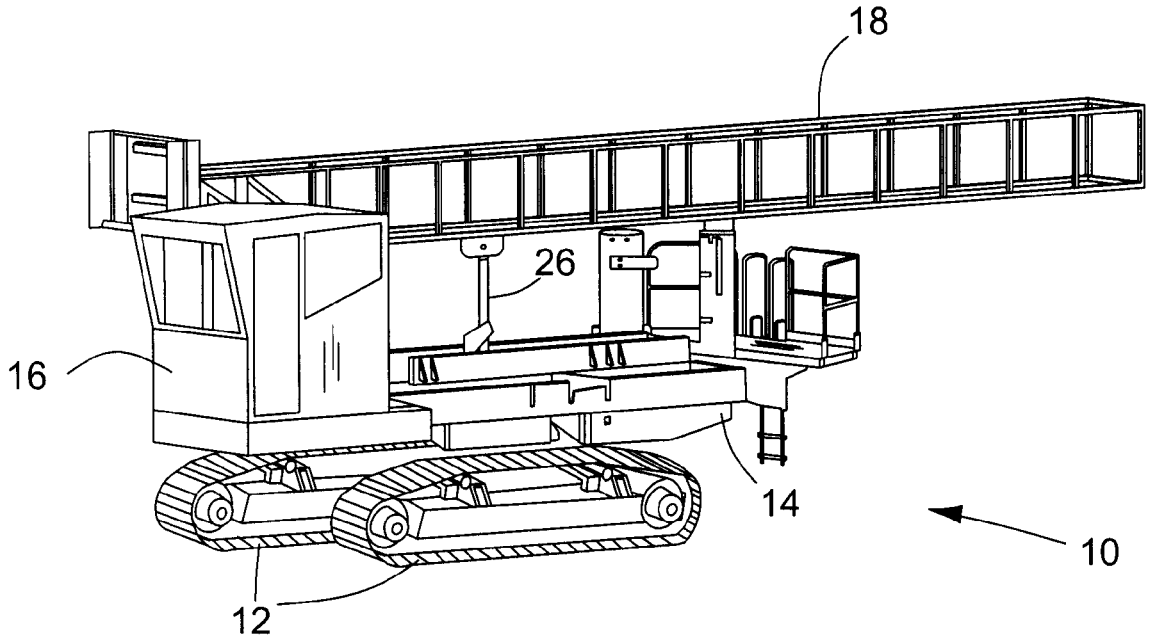
FIG. 2 is a simplified perspective view of the drilling machine of FIG. 1 showing the tower in a horizontal position (not showing the rotary head, feed cable system, and drill string)

FIGS. 1 and 2 illustrate simplified side and perspective views of a drilling machine 10 embodying the present invention. In the illustrated embodiment, the drilling machine 10 includes a pair of tracks 12 for movement over the ground 28, a frame 14, an operator cab 16, a tower 18, a rotary head 20, a drill string 22, and a feed cable system 24. The operator cab 16 is mounted to the frame 14. The tower 18 is pivotally mounted on the frame 14 and is movable between a substantially horizontal position for transport, such as shown in FIG. 2, and a substantially vertical position for drilling, such as shown in FIG. 1. The tower 18 is sometimes referred to as a derrick or mast and is movable relative to the frame 14 by a tower lift cylinder 26. The rotary head 20 is connected to the tower 18, the drill string 22, and the feed cable system 24. The rotary head 20 also includes a motor (not shown) that rotates the drill string 22, and in conjunction with the feed cable system 24 which moves the rotary head 20 downward, the rotary head 20 is operable to force the drill string 22 downward to penetrate the ground 28 and create a drilled hole, as is known in the art. Varying the position of the tower 20 varies the angle of drilling.

As the drilling machine 10 is moving over uneven terrain, the tracks 12 may encounter various forces, with the magnitude of those forces in part dependent on the speed and orientation of the drilling machine 10. Further, the front of one track may be at a different elevation than the back of that track, and/or each track may be at a different elevation with respect to the other, such that the frame 14 may not be level with respect to gravity. As a general overview, the drilling machine 10 includes an active suspension system that is operable to minimize the forces felt by an operator in the operator cab 16 as the drilling machine 10 is moving. Further, the active suspension system 54 is operable to level the frame 14 with respect to gravity under a plurality of conditions. Specifically, the system 54 is operable to level the frame 14 when the tracks are parallel to each other but the front of the tracks 12 are at a different elevation than the back of the tracks 12 (front to back), when the tracks are parallel to each other but one track is at a different elevation than the other track (side to side), and when the tracks 12 are not parallel to each other (three point leveling). The active suspension system 54 is operable to level the frame both when the drilling machine 10 is moving over the ground and when the drilling machine 10 is stationary.

Figure 3:
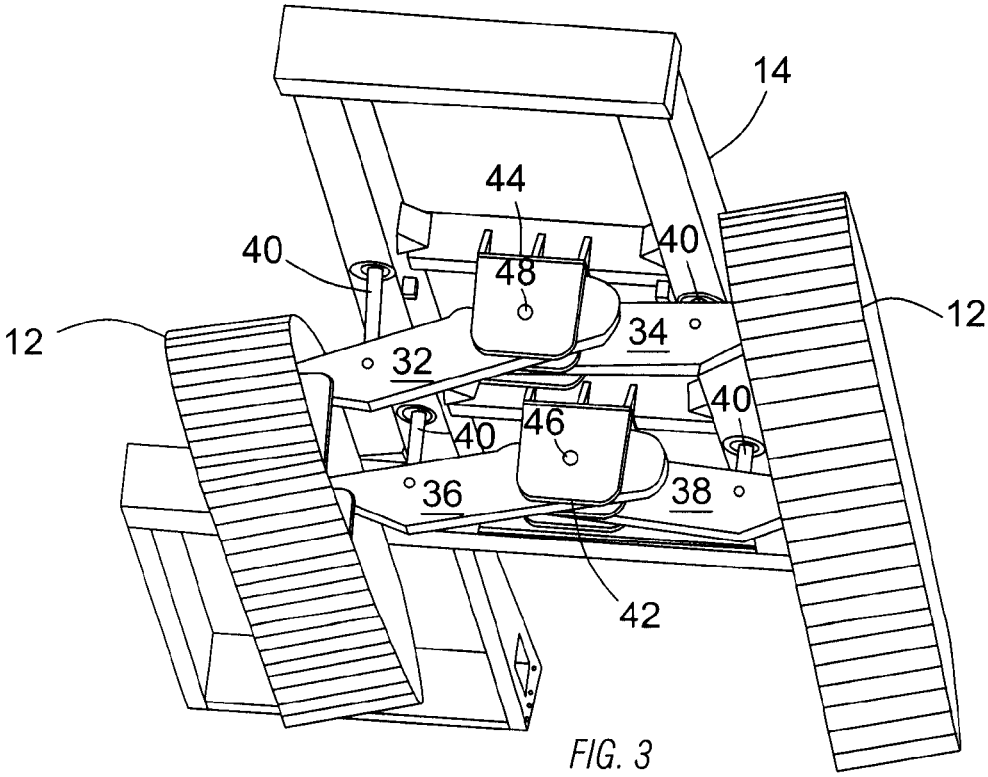
FIG. 3 is a simplified perspective view of the underside of the drilling machine of FIG. 1.
Figure 4:
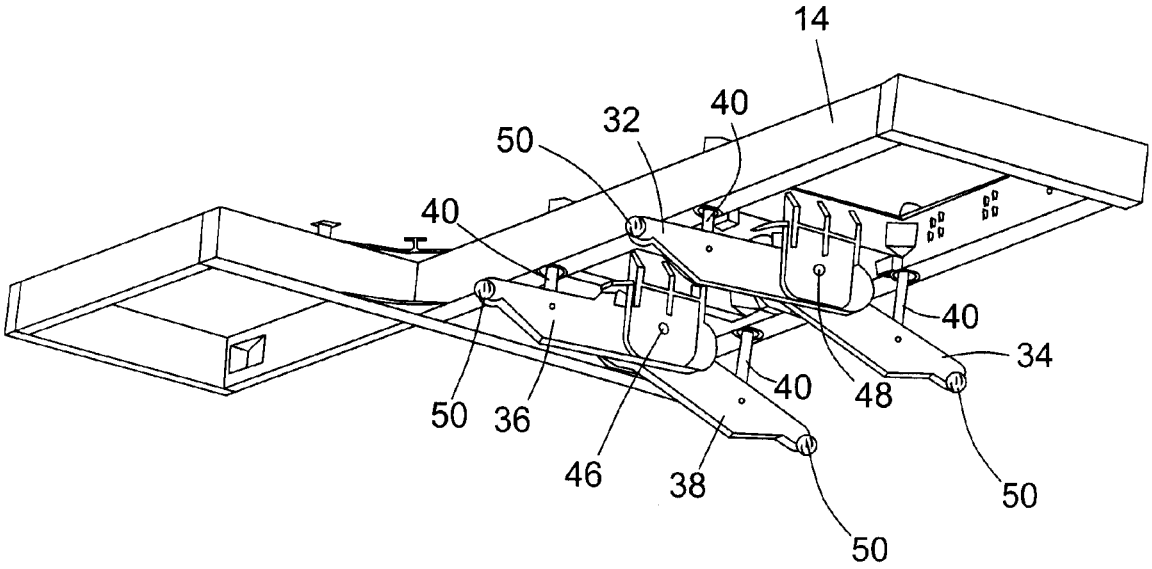
FIG. 4 is a view similar to that of FIG. 3 but without the tracks.

Referring to FIGS. 3-6, the drilling machine 10 includes a plurality of yokes 32, 34, 36, 38 interconnecting the tracks 12 and the frame 14. Each of a plurality of hydraulic cylinders 40 has a first end connected to the frame 14 and a second end connected to an associated yoke. In the illustrated embodiment, there are four yokes 32, 34, 36, 38 and four hydraulic cylinders 40. As best seen in FIGS. 3 and 4, the frame 14 includes a front attachment member 42 and a rear attachment member 44, and two yokes 36, 38 are pivotably connected to the front attachment member 42, and two yokes 32, 34 are pivotably connected to the rear attachment member 44. In the illustrated embodiment, the yokes 36, 38 are connected to the frame 14 at the same pivot point 46, and the yokes 32, 34 are connected to the same pivot point 48. However, these yokes could also be attached at different pivot points, or to separate attachment members.

Figure 5:
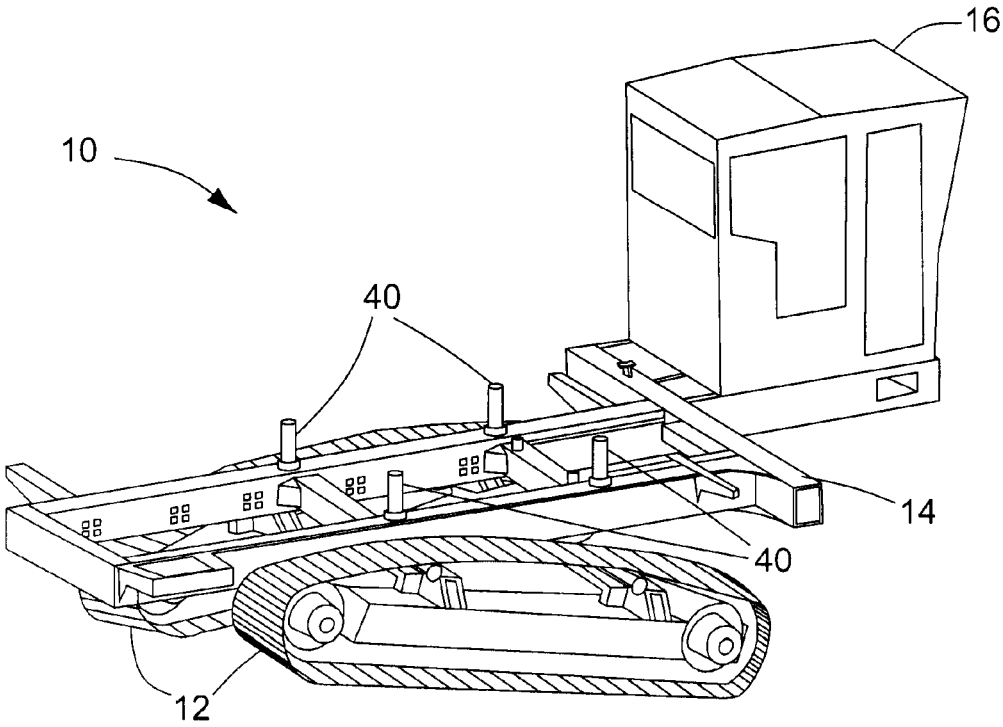
FIG. 5 is a simplified perspective view of the drilling machine of FIG. 1 illustrating the hydraulic cylinders.

Yokes 32, 36 are connected to one of the tracks 12, and yokes 34, 38 are connected to the other track 12. With reference to FIG. 4, in one embodiment each yoke 32, 34, 36, 38 is rotatably connected to one of the tracks 12 using a ball joint. In particular, each yoke includes a ball 50 that is movable with respect to a corresponding socket (not shown) on the track 12, thereby allowing three degrees of freedom of motion of each track 12 relative to each respective yoke. This allows both tracks to rotate with respect to the yokes to follow the contours of the ground such that the tracks need not remain parallel to each other, as shown in FIG. 5.

Each yoke 32, 34, 36, 38 is pivotable relative to the frame 14 using a corresponding hydraulic cylinder 40. Each hydraulic cylinder 40 includes a controllable valve 52 (see FIG. 7) and is extendible and retractable in response to an associated control signal. As more fully explained below, a control signal from a controller 56 coupled to the valve 52 can be used to control the pressure of hydraulic fluid applied in order to extend and retract the respective hydraulic cylinder 40 in a desired manner. Hydraulic fluid is supplied using a pump (not shown) powered by the power source of the drilling machine 10, e.g., a diesel engine or electric motor.

Figure 7:
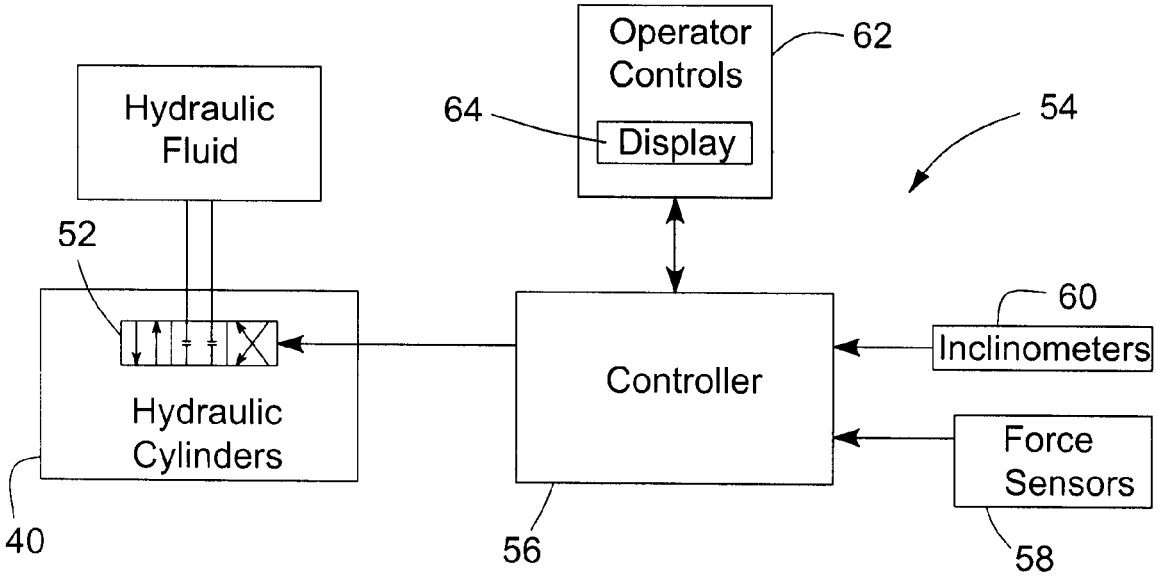
FIG. 7 is a schematic diagram of the active suspension system for the drilling machine of FIG. 1.

With respect to FIG. 7, the drilling machine 10 includes a control system 54 that is part of the active suspension system. In one embodiment, the control system 54 is operable in one of several modes: a force control mode, an auto-leveling mode, or a combination mode. In particular, the control system 54 includes the controller 56, sensors 58 for sensing a parameter indicative of a force and providing an output signal representing that force, and one or more inclinometers 60 for sensing the inclination of the frame 14 and providing an output signal representing the inclination of the frame 14. The controller 56 receives output signals from these sensors 58, 60, and is operable to generate control signals, with a control signal associated with each of the hydraulic cylinders 40. The controller 56 communicates with each of the valves 52 of the hydraulic cylinders 40 and is operable to independently control the extension and retraction of each hydraulic cylinder 40.

As mentioned, the sensors 58 each sense a parameter that is indicative of a force and provide an output signal representing that force. In one embodiment, each sensor provides an output signal indicative of a force at a hydraulic cylinder. In one embodiment, the sensors 58 are force sensors. In a preferred embodiment, there are four sensors 58, each mounted within a respective hydraulic cylinder 40 to sense a pressure of the hydraulic fluid. The pressure of the hydraulic fluid is indicative of the force at that hydraulic cylinder. However, in other embodiments, a different number of sensors can also be employed, different types of sensors can be employed, and these sensors can be positioned at different locations such that the force at a hydraulic cylinder 40 is not directly sensed, but can be derived from knowledge of these locations and the output signal from one or more of the sensors 58.

Although only a single inclinometer 60 is required by control system 54, in one embodiment two or more inclinometers 60 are used in order to provide redundancy. These inclinometers 60 are mounted to the frame 14 and each provides an output signal indicative of the inclination of the frame 14 relative to gravity. With more than one inclinometer, the controller 56 may compute an average of the output signals from each, or compare the different output signals as a safety measure to ensure that both values are within an acceptable accuracy range.

In the force control mode, the object of the control system 54 is to at least partially isolate the frame 14 from the forces on the tracks 12 due to tramming on uneven terrain. In the force control mode, the controller 56 performs force control only. In particular, when the drilling machine 10 is moving over the ground, the controller 56 monitors the output signals from each of the sensors 58 and determines a force deviation for each hydraulic cylinder 40. The controller 56 generates a control signal for each hydraulic cylinder based on an associated force deviation, wherein each hydraulic cylinder is controlled to retract or extend when the associated force deviation is greater than a predetermined magnitude.

In one embodiment, the force deviation can be representative of the rate of change of a force, and a hydraulic cylinder can be controlled to expand or retract if the rate of change exceeds a predetermined magnitude.

In another embodiment, the force deviation for each hydraulic cylinder 40 is simply a difference between a tramming force and a nominal force. In one embodiment, the nominal force is a value corresponding to an output signal of an associated sensor 58 at a single point or multiple points in time when the drilling machine 10 is stable and not subject to a dynamic force. A tramming force is a value corresponding to an output signal of the associated sensor 58 at a single point or multiple points in time when the drilling machine 10 is moving and subject to a dynamic force.

In the case that the sensors 58 do not directly measure forces at corresponding hydraulic cylinders, the controller 56 can calculate the force deviation for each hydraulic cylinder 40 based on the locations of the sensors 58 with respect to that hydraulic cylinder, and the output signals of the sensors.

When a determined force deviation is greater than a predetermined magnitude, then the associated hydraulic cylinder 40 is controlled to retract or expand. In one embodiment, when a force deviation is representative of an upward force deviation on the tracks, then the hydraulic cylinder is controlled to retract, and when a force deviation is representative of a downward force deviation on the tracks, then the hydraulic cylinder is controlled to extend.

In one embodiment, a sensor 58 is associated with each hydraulic cylinder and senses the pressure of hydraulic fluid in each respective hydraulic cylinder 40. If there is a dynamic upward force on a track 12, such as when the left front track hits a rock, this would be sensed by the left front sensor 58 in a corresponding hydraulic cylinder 40 and this sensor will provide an output signal representing this force. The controller 56 is programmed to monitor this output signal at one or more times and will determine an associated force deviation for the front left hydraulic cylinder by comparing a tramming force to a nominal force, or by determining a rate of change of this output signal. If a force deviation is greater than a predetermined value, the controller 56 then will generate a control signal sent to the valve 56 of the front left hydraulic cylinder such that this cylinder is controlled to retract. Once the tramming force for the front left hydraulic cylinder returns to within a predetermined range of the nominal force value, or the magnitude of the rate of change of the output signal falls below a predetermined magnitude, then the front left hydraulic cylinder 40 can be controlled to return to its original position.

In this manner, the forces on the tracks 12 are not fully transmitted to the frame 14, such that an operator in the operator cab 16 does not feel the full impact of the forces on the tracks 12 as the drilling machine 10 is moving over the ground 28.

In the auto-leveling mode, the controller 56 monitors the output signal from the inclinometer 60 (or the signals from multiple inclinometers), whether the drilling machine 10 is moving or is not moving, and performs auto-leveling only. The inclinometer output signal is indicative of the inclination of the frame 14 with respect to gravity. If the controller 56 detects that the frame 14 is not level, the controller 56 generates control signals that are sent to one or more of the hydraulic cylinders 40 to effect incremental adjustments to place the frame 14 in a level orientation. In other words, the frame 14 can be maintained substantially perpendicular to the direction of gravity: both side to side, front to back, and when the tracks are not parallel to each other.

Figure 6:
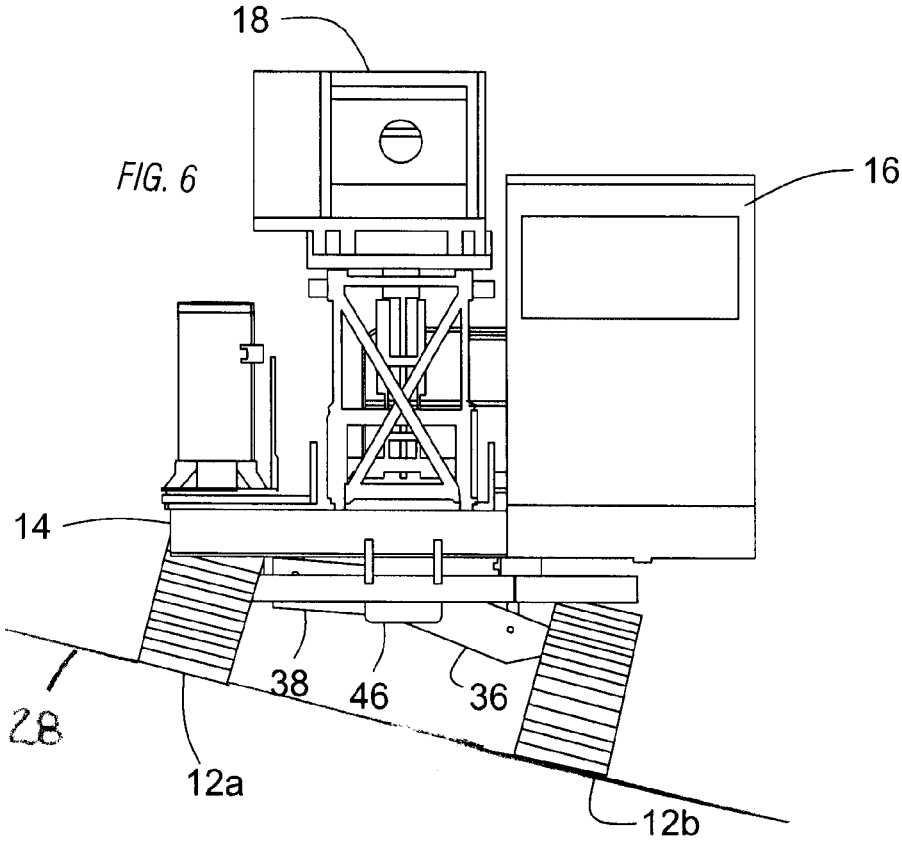
FIG. 6 is a front view of the drilling machine of FIG. 1 on uneven terrain illustrating the frame in a level position.

For example, with reference to FIG. 6, if the drilling machine 10 is driven along the side of a hill such that one track 12*a* is higher than the other 12*b*, the controller 56 controls the hydraulic cylinders 40 such that the hydraulic cylinders 40 on the right are extended, the hydraulic cylinders 40 on the left are retracted, or a combination of these actions occurs. In general, since three points determine a plane and one point can be taken as a reference point, only two (if only side to side or front to back positioning is required) or three of the four hydraulic cylinders 40 will need to be adjusted in the auto-leveling mode.

In another embodiment, since the forces at a plurality of locations can also be monitored, the center of gravity of the drilling machine 10 can also be determined and monitored. Further, the actuation of the extension and retraction of the hydraulic cylinders to level the drilling machine can be determined by the center of gravity. In particular, the controller 56 can determine whether the center of gravity is within a predetermined boundary area, or area of stability. The boundary area can be defined as required. For example, the boundary area can be rectangular and defined by the longitudinal axes of the tracks 12*a*, 12*b* and the hubs of the tracks. Further, the boundary area can also take into account a margin of error, which may be different depending on whether the drilling machine 10 is tramming or whether it is stationary and performing drilling. The location of the center of gravity may be displayed on the display along with an image of the drilling machine 10. The controller 56 can generate control signals for the hydraulic cylinders based on the location of the center of gravity with respect to the boundary area, wherein each hydraulic cylinder is controlled to retract or extend to maintain the center of gravity within the predetermined boundary area.

In the combination mode, the controller 56 monitors the output signals from the sensors 58 and the inclinometers 60 to provide both force control and auto-leveling. In some cases, it is possible for both force control and auto-leveling functions to be operable at substantially the same time. For example, if the front left track of drilling machine hits a rock, this event will be sensed as an upward force by a front left sensor 58 and this sensor 58 will provide an output signal indicative of this force. The controller 56 will generate a control signal that is sent to the valve 52 of the front left hydraulic cylinder 40, and the cylinder 40 will be controlled to retract. At substantially the same time, using the height of the front left hydraulic cylinder 40 as a reference, the controller 56 can generate control signals to also retract the other three hydraulic cylinders 40 to level the frame with respect to gravity.

In other cases, in the combination mode, the controller 56 switches between force control and auto-leveling, such that only one of these functions is performed at a given time. For example, in such a case, the controller 56 can automatically determine whether to provide force control or auto-leveling. In one embodiment, a threshold speed is selected such that when the drilling machine 10 is moving at a speed less than the threshold speed, the controller 56 only performs auto-leveling. When the drilling machine 10 is moving at a speed greater than the threshold speed, the controller 56 only performs force control, unless the frame 14 tilts more than a predetermined amount. If the frame 14 tilts more than a predetermined amount, the controller 56 switches to performing the auto-leveling function until the frame 14 is again level, and then the controller 56 switches back to force control only. A selected threshold speed could be 1.5 miles per hour.

Various other ways to implement the combination mode can also be envisioned. For example, the controller may perform force control for a short period of time, then perform auto-leveling for a short period of time, and keep switching back and forth, according to various other conditions.

One or more controls 62 can be provided in the operator cab 16 so that an operator can select between two or more of the following operating options: manual operation of each hydraulic cylinder 40, operation in the force control mode, operation in the auto-leveling mode, or operation in the combination mode. The selected mode of operation can be displayed on a display 64.

Many advantages are provided by a drilling machine 10 having an active suspension system such as described herein. The force control mode provides a more comfortable ride for the operator by decreasing shocks and vibration when the drilling machine 10 is transported over uneven terrain. The force control mode also permits faster tramming speeds. Further, this mode reduces mechanical stresses on the drilling machine components thereby increasing their useful lifetimes.

Additionally, the auto-leveling mode eliminates the necessity for jacks and provides an additional measure of safety to the operator. By maintaining the frame 14 level as the drilling machine 10 is transported, the center of gravity of the drilling machine is maintained in a stable region between the tracks. Further, the operator does not slide out of the chair, and is not distracted with having to brace himself, thereby allowing increased attention to operation of the drilling machine. Time is also saved since it is not necessary to go through the leveling process after the drilling machine 10 is moved to its desired drilling position, since leveling can be accomplished as the drilling machine 10 is moved.

Various features and advantages of the invention are set forth in the following claims.

What is claimed is:

1. A drilling machine, comprising:

a frame, a tower supported by the frame and including a drill string, two tracks for movement over the ground, at least three yokes interconnecting the frame and the two tracks, each yoke pivotably connected to the frame and connected to one of the tracks, at least three hydraulic cylinders, each hydraulic cylinder being extendible and retractable in response to an associated control signal and connected to the frame and to an associated yoke, an inclinometer for sensing the inclination of the frame and producing an output signal indicative of the inclination of the frame, and a controller that receives the output signal from the inclinometer and generates control signals for the hydraulic cylinders, wherein the hydraulic cylinders are controlled to extend or retract to maintain the frame in a level position, even when the tracks are not parallel to each other.

2. The drilling machine of claim 1, wherein there are an equal number of yokes and hydraulic cylinders.

3. The drilling machine of claim 2, wherein each yoke is rotatably connected to a track.

* * * * *